United States Patent [19]

Andren

[11] Patent Number: 4,957,618

[45] Date of Patent: Sep. 18, 1990

[54] VERTICAL SCREENING DEVICE

[75] Inventor: Ingmar Andren, Lindesberg, Sweden

[73] Assignee: Lindema Kommanditbolag, Lindesberg, Sweden

[21] Appl. No.: 347,046

[22] PCT Filed: Oct. 14, 1987

[86] PCT No.: PCT/SE87/00466

§ 371 Date: Apr. 7, 1989

§ 102(e) Date: Apr. 7, 1989

[87] PCT Pub. No.: WO88/03061

PCT Pub. Date: May 5, 1988

[30] Foreign Application Priority Data

Oct. 22, 1986 [SE] Sweden ..... 8604513

[51] Int. Cl.[5] ..... B07B 1/22

[52] U.S. Cl. ..... 209/303; 209/243; 209/254; 209/411

[58] Field of Search ..... 209/303, 304, 301, 243, 209/247, 252, 254, 409, 410, 411, 263

[56] References Cited

U.S. PATENT DOCUMENTS

| | | | |
|---|---|---|---|
| 263,564 | 8/1882 | Nielsen | 209/306 |
| 745,743 | 12/1903 | Thayer | 209/296 X |
| 4,645,590 | 2/1987 | Satake | 209/304 |

FOREIGN PATENT DOCUMENTS

| | | |
|---|---|---|
| 150100 | 12/1986 | Denmark . |
| 0185843 | 7/1986 | European Pat. Off. . |
| 434349 | 7/1984 | Sweden . |
| 239703 | 3/1969 | U.S.S.R. . |
| 435867 | 7/1974 | U.S.S.R. . |
| 1256785 | 9/1986 | U.S.S.R. . |
| 1458003 | 6/1989 | U.S.S.R. . |

*Primary Examiner*—Donald T. Hajec

*Attorney, Agent, or Firm*—Shapiro and Shapiro

[57] ABSTRACT

Vertical screening device (1) having at least one cylinder screen (2) and connectible with its lower end portion (8) to a similar screening device or a drive unit and, with its upper end portion (7), to a similar screening device or a distributor device. The screening device is adapted, together with the other devices connected to it, to be imparted a movement of rotation. The invention is charaterized in that the screening device (1) comprises a bearing device (3) for supporting a feed screw (4) cooperating with the cylinder screen (2). The bearing device (3) is disposed within the cylinder screen (2) and fixedly connected thereto. The feed screw (4) is connected through a link (5) extending outside the periphery of the cylinder screen (2), to a fixed point (6) provided outside the screening device (1) for holding the feed screw (4) stationary.

10 Claims, 3 Drawing Sheets

VERTICAL SCREENING DEVICE

BACKGROUND OF THE INVENTION

The present invention relates to vertical screening devices, and more particularly to a vertical screening device having at least one cylinder screen and adapted to be connected with its lower end portion to a similar screening device or a drive unit and, with its upper end portion, to a similar screening device or a distributor device, said screening device further being adapted, together with the other devices connected thereto, to be imparted a movement of rotation. The screening device may thus be of the type disclosed in Swedish Patent No. 434,349, although it must not necessarily be imparted an oscillating angular velocity. The screening device is so designed that it can be removed laterally once the connections with the other devices have been undone.

SUMMARY OF THE INVENTION

The novel features of the invention reside in that the screening device comprises a bearing device for a feed screw cooperating with the cylinder screen, said bearing device being disposed within the cylinder screen and fixedly connected thereto, and said feed screw being connected through a link extending outside the periphery of the cylinder screen, to a fixed point provided outside the screening device for holding the feed screw still. The advantage of a stationary feed screw is that the screening material to be fed is imparted a predetermined feed rate, and that the material moves helically downwards in the cylinder screen. This means improved distribution and mixing of the screening material. Thus, the present invention has made it possible to use a stationary feed screw in the screening device contemplated.

BRIEF DESCRIPTION OF THE DRAWINGS

The invention will be described in more detail hereinbelow with reference to the accompanying drawings showing, by way of example only, one embodiment of the screening device.

DESCRIPTION OF THE PREFERRED EMBODIMENT

Figure 1:
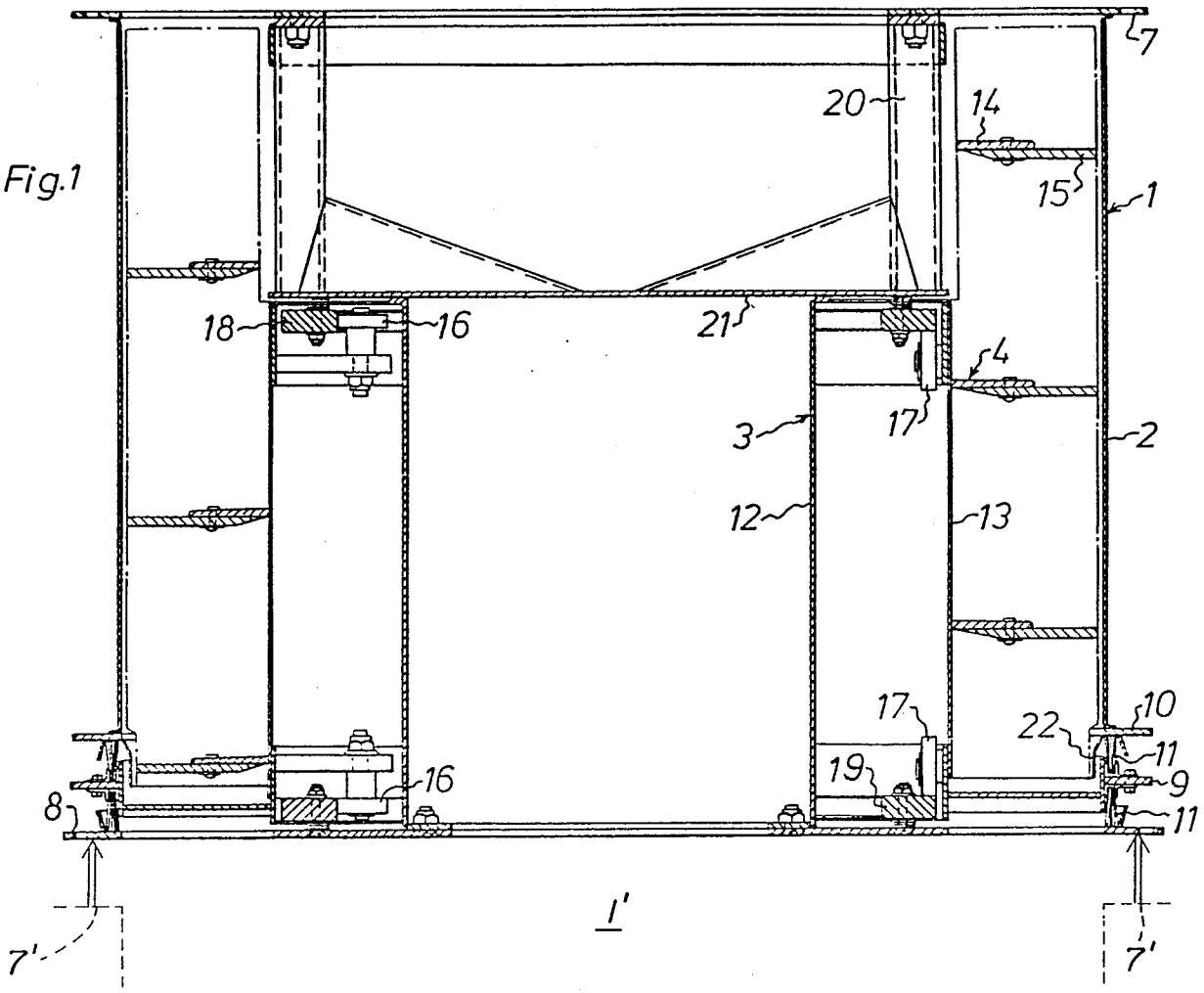
FIG. 1 shows the screening device in vertical cross-section.

The screening device 1 comprises a bearing device 3, disposed within a cylinder screen 2 and fixedly connected thereto. The bearing device supports a feed screw 4 which cooperates with the cylinder screen 2 and which is connected through a link 5 (FIG. 5) extending outside the periphery of the cylinder screen 2, to a fixed point 6 provided outside the screening device 1 for holding the feed screw 4 stationary. More specifically, the fixed point 6 is located at a fixed outer cylinder 23 disposed outside the screening device 1.

The bearing device 3 constitutes a fixed connection, for transmitting rotational and torsional forces between upper and lower end portions 7 and 8, respectively, of the screening device 1, which suitably consist of flanges. The cylinder screen 2 is, however, fixedly connected to only end portion 7, there being a space defined between the cylinder screen 2 and the other end portion 8. This space is used for accommodating the connection between the link 5 and the feed screw 4.

The link 5 of the feed screw 4 is fixed to a flange 9 fixedly connected to the feed screw 4 and located opposite the end flange 8 and opposite a corresponding flange 10 on the cylinder screen 2. Sealing means 11 are provided between the flanges 8, 9 and 10. As seen in the drawings, the sealing means 11, here being brushes, are mounted on the flange 9 so as to engage the flanges 8 and 10.

Figure 5:
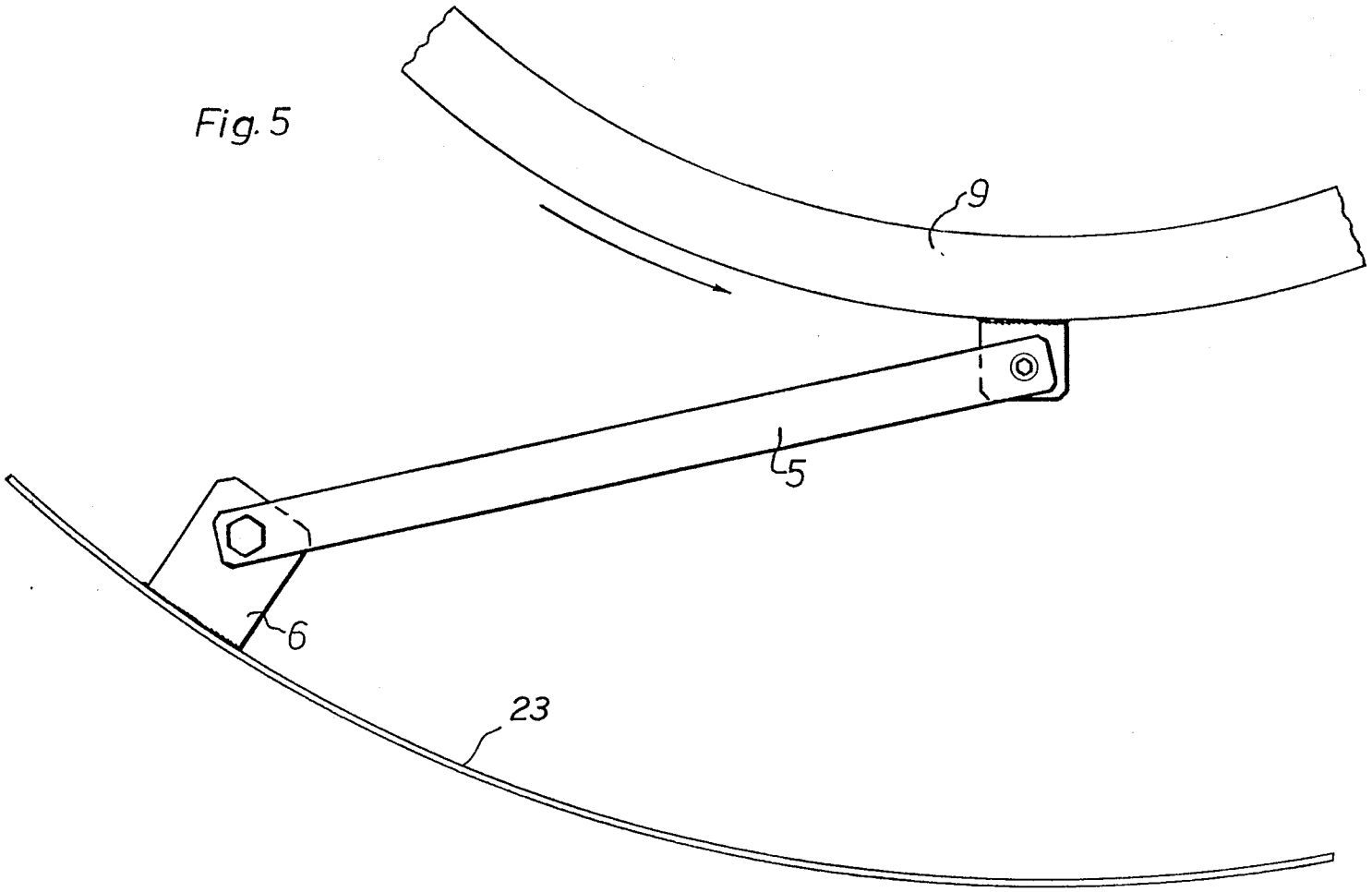
FIG. 5 is a top plan view showing the link with the parts associated therewith.

As will be appreciated from FIGS. 1 and 5, the link 5 is fixed to the outer side of the flange 9 outwardly of the sealing means 11, whereby the link 5 will in no way interfere therewith.

The bearing device 3 comprises a cylindrical tube 12 which is lower than the screening device 1. The feed screw 4 is mounted around the tube 12 by means of a substantially equally high tubular central body 13, while the screw 14 itself extends with a fully open part above the tubular central body 13. The body 13 suitably consists of a thin-walled steel cylinder on the outer side of which a steel helix forming the screw 14 proper is wound and fixed by welding. A rubber helix 15 is fixed to the underside of the steel helix 14.

The tubular central body 13 is provided on its inside with rollers 16 and 17 which are adapted to roll on tracks 18 and 19 provided at the outer side of the cylindrical tube 12 of the bearing device 3. This roller and track arrangement serves to guide the bearing 3 relative to feed screw 4, both axially and radially. The rollers 16, for radial guiding, are suitably six in number and evenly distributed pairwise along the periphery. The rollers 17, for axial guiding, are suitably four in number and pairwise diametrically disposed. The tracks 18 and 19 preferably consist of plastic rings.

Figure 2:
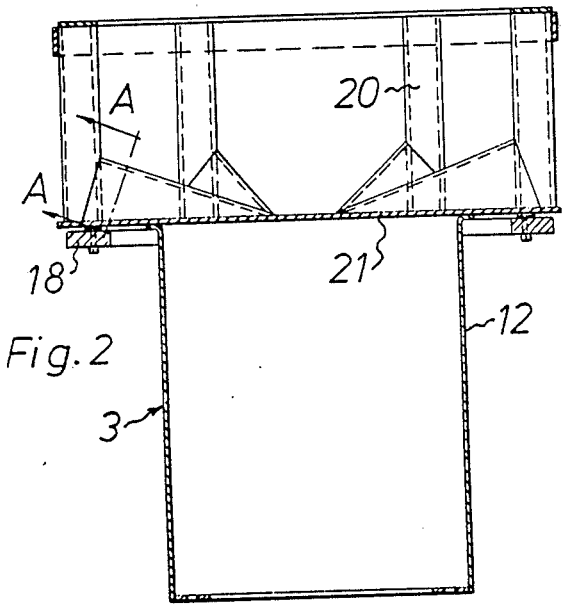
FIG. 2 shows the bearing device in vertical cross-section.
Figure 4:
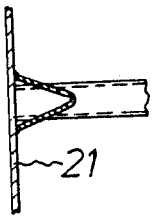
FIG. 4 is a section taken along the line A—A in FIG. 2.
Figure 3:
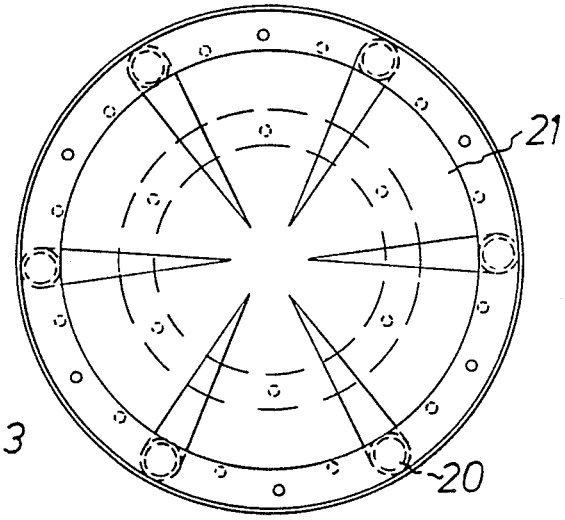
FIG. 3 shows the bearing device from above.

Referring additionally to FIG. 2, the bearing device 3 comprises a number of axially extending rods 20 which are disposed above the cylindrical tube 12 and evenly distributed along the inner periphery of the feed screw 4. Further, between the cylindrical tube 12 and the axially extending rods 20 there is provided a radial plate 21. By this arrangement and by the bearing device 3 being directly or indirectly connected to the flanges 7 and 8 at its upper and lower portions, the bearing device 3 serves to transmit rotational and torsional forces between the flanges 7 and 8.

At its lower end, the cylinder screen 2 is provided with an inwardly directed cone 22 for guiding the screening material so that it will not unecessarily interfere with the brushes serving as sealing means 11.

The interconnection of two screening devices 1 and 1' according to the invention can be brought about by connecting the upper flange of one device (e.g., flange 7' of device 1' directly to the lower flange of the other device (e.g., flange 8 of device 1), as indicated diagrammatically in FIG. 1. As in the patent mentioned above, use may however be made of a flanged ring or the like as coupling means.

The invention is not restricted to the embodiment described above and illustrated in the drawings, but may be modified within the spirit and scope of the accompanying claims.

I claim:

1. A vertical screening device, comprising a vertical cylinder screen, a vertical feed screw received in said cylinder screen and cooperating with an interior surface thereof, bearing means received in said feed screw for supporting said feed screw, said bearing means being rotatable on a vertical axis of said cylinder screen and fixedly connected to said cylinder screen, and connecting means including a link connecting said feed screw to a fixed point outside said cylinder screen for holding said feed screw stationary.

2. A vertical screening device according to claim 1, further comprising an upper end portion fixedly connected to said bearing means and to said cylinder screen, and a lower end portion fixedly connected to said bearing means, and wherein a space is provided between said cylinder screen and said lower end portion for accommodating a connection between said feed screw and said link.

3. A vertical screening device according to claim 2, wherein said upper end portion is constituted by an upper peripheral first flange and said lower end portion is constituted by a lower peripheral second flange.

4. A vertical screening device according to claim 3, further comprising a peripheral third flange connected to said cylinder screen, and wherein said connecting means comprises a peripheral fourth flange disposed between and facing said second and third flanges, and sealing means is provided between said second and third flanges and said third and fourth flanges.

5. A vertical screening device according to claim 3, wherein said bearing means comprises a cylinderical tube of smaller height than said cylinder screen and disposed toward a lower end of said cylinder screen, said feed screw has a tubular central body of substantially the same height as said cylindrical tube and surrounding said cylindrical tube along substantially the full tube height, and said feed screw has an internally open portion extending above said tubular central body.

6. A vertical screening device according to claim 5, wherein said tubular central body and said cylindrical tube are provided with cooperable rollers and tracks for guiding said bearing means relative to said feed screw, both radially and axially.

7. A vertical screening device according to claim 6, wherein said bearing means includes a plurality of axially extending rods disposed above said cylindrical tube and evenly distributed along an inner periphery of said feed screw.

8. A vertical screening device according to claim 7, wherein said bearing means includes a radially extending plate disposed between said cylindrical tube and said rods.

9. A vertical screening system, comprising a pair of vertical screening devices connected vertically end-to-end, each screening device including a vertical cylinder screen, a vertical feed screw received in said cylinder screen and cooperating with an interior surface thereof, bearing means received in said feed screw for supporting said feed screw, said bearing means being rotatable on a vertical axis of said cylinder screen and fixedly connected to said cylinder screen, and connecting means including a link connecting said feed screw to a fixed point outside said cylinder screen for holding said feed screw stationary, the respective bearing means of said screening devices being connected for joint rotation.

10. A vertical screening system according to claim 9, wherein each screening device includes and upper-end peripheral flange and a lower-end peripheral flange both fixedly connected to the bearing means of that screening device, and wherein the upper-end flange of one of said screening devices is connected to the lower-end flange of the other of said screening devices.

* * * * *